US009399283B2

(12) United States Patent
Redrick

(10) Patent No.: US 9,399,283 B2
(45) Date of Patent: Jul. 26, 2016

(54) TOOL BOX SYSTEM

(71) Applicant: Osceola Redrick, San Pablo, CA (US)

(72) Inventor: Osceola Redrick, San Pablo, CA (US)

( * ) Notice: Subject to any disclaimer, the term of this patent is extended or adjusted under 35 U.S.C. 154(b) by 0 days.

(21) Appl. No.: 13/847,483

(22) Filed: Mar. 19, 2013

(65) Prior Publication Data

US 2014/0284235 A1 Sep. 25, 2014

(51) Int. Cl.
*B25H 3/02* (2006.01)

(52) U.S. Cl.
CPC ..... *B25H 3/022* (2013.01)

(58) Field of Classification Search
CPC ..... B25H 3/022; B65D 85/28; H01F 7/20
USPC ..... 206/562, 564, 350, 349
See application file for complete search history.

(56) References Cited

U.S. PATENT DOCUMENTS

| | | | | | |
|---|---|---|---|---|---|
| 74,254 | A | | 2/1868 | Taggart | |
| 84,342 | A | | 11/1868 | Chase | |
| 4,167,230 | A | * | 9/1979 | Barratt | 206/380 |
| 4,303,158 | A | | 12/1981 | Perkins | |
| 4,823,944 | A | * | 4/1989 | Ryder | 206/5.1 |
| 4,826,059 | A | | 5/1989 | Bosch | |
| 5,071,004 | A | | 12/1991 | Rivera | |
| 5,535,882 | A | | 7/1996 | Liu | |
| 5,660,276 | A | * | 8/1997 | Winnard | B25H 3/06 206/350 |
| 5,669,516 | A | * | 9/1997 | Horn | B25H 3/06 206/350 |
| 5,760,668 | A | * | 6/1998 | Testa et al. | 335/285 |
| 5,868,251 | A | | 2/1999 | Lin | |
| 5,967,641 | A | | 10/1999 | Sung et al. | |
| 6,047,824 | A | | 4/2000 | Winnard | |
| 6,267,277 | B1 | | 7/2001 | Taylor | |
| 6,516,555 | B2 | * | 2/2003 | Buzzell | A01K 97/06 43/57.1 |
| 6,868,967 | B2 | | 3/2005 | Lam | |
| 6,915,900 | B2 | | 7/2005 | Chen | |
| 6,923,317 | B2 | | 8/2005 | Coleman, Jr. | |
| 7,699,176 | B2 | | 4/2010 | Lin | |
| 7,789,229 | B2 | | 9/2010 | Frakes | |
| 7,837,033 | B2 | | 11/2010 | Schein et al. | |
| 2004/0084342 | A1 | * | 5/2004 | Chang | 206/378 |
| 2011/0048988 | A1 | | 3/2011 | Kotula et al. | |
| 2011/0074262 | A1 | | 3/2011 | Liu | |

* cited by examiner

*Primary Examiner* — Anthony Stashick
*Assistant Examiner* — Raven Collins
(74) *Attorney, Agent, or Firm* — NWAMU, PC

(57) ABSTRACT

A tool box system. One or more magnets are strategically oriented, aligned, and sized to attract and secure the various types of tools within the tool box. Each magnet can be aligned, oriented, dimensioned, and sized to increase the magnetic field or decrease the magnetic field, depending on the desired strength and direction of the magnetic attraction between the magnets and the tools. The manipulation of each magnet is useful for tailoring a desired magnetic attraction between the tools and the magnets.

13 Claims, 3 Drawing Sheets

TOOL BOX SYSTEM

CLAIM OF PRIORITY

The present application claims priority from U.S. Provisional Patent Application No. 61/685,435 entitled Magnabox, filed Mar. 19, 2012, the entirety of which is hereby incorporated by reference as if fully set forth in the present specification.

BACKGROUND OF THE INVENTION

The present invention relates generally to tool box systems and more specifically to tool box systems for organizing tools and other accessories within a tool box.

Tool boxes are generally used to store a variety of tools. For example, an auto mechanic tool box set might include a wrench, a socket and other like devices. A home hobbyist's tool set can include screw drivers, bolts and nuts, pliers, etc. for minor repairs and other Do-It-Yourself tasks around the home.

In use, a typical auto repair person uses the tool box for automobile repair by placing the open tool box at a comfortable vantage point while standing, sitting or lying down beside the automobile. The tool box can then be easily reached at arm-length to retrieve an appropriate tool as work proceeds.

During auto repair, an auto repair person might inadvertently knock the tool box over, dislodging and spilling the tool box contents on the ground. And so, inconveniently, the auto repair person must necessarily stop work to recover the tools.

Even worse, the auto repair person might be working in dim conditions with minimal visibility such as when the auto repair person is working under an automobile. When tools are spilled, the auto repair person must also obtain a flashlight or the like, then proceed to locate the knocked over tools, place them in the tool box before the auto repair work can be resumed.

It is within the aforementioned context that a need for the present invention has arisen. Thus, there is a need to address one or more of the foregoing disadvantages of conventional systems and methods, and the present invention meets this need.

BRIEF SUMMARY OF THE INVENTION

Various aspects of a tool box system can be found in exemplary embodiments of the present invention.

In a first embodiment, a tool box system comprises a tool box for organizing, securing, and accessing a variety of tools within a tool box. The tool box system uses one or more magnets strategically oriented, aligned, and sized to attract and secure the various types of tools within the tool box. Each magnet can be aligned, oriented, dimensioned, and sized to increase the magnetic field or decrease the magnetic field, depending on the desired strength and direction of the magnetic attraction between the magnets and the tools.

The manipulation of each magnet is useful for tailoring a desired magnetic attraction between the tools and the magnets. For example, lighter tools do not need to be attracted too strongly to the magnet or they will be difficult to remove from the tool box. Heavier tools, on the other hand, will dislodge from their respective location in the tool box if the magnetic attraction is too weak.

In some embodiments, the tool box comprises a body for containing the various components of the tool box system. The body has a lower body portion made up of sidewall panels and a lower panel. A base rests inside the lower body portion, acting as a panel for the magnets.

The magnets generate a magnetic field that passes through to create a magnetic force between the tools and the magnets. The tools rest on a tool surface of the lower panel, while the magnets rest on the magnet surface of the base. In some embodiments, the tool surface comprises tool recesses that contour to the shape of each tool. The tool recesses are helpful for organizing the tools inside the box.

A space can exist in the tool recess so that each tool and its respective magnet are in contact. In one embodiment, the magnet can be a narrow bar that is long enough to bridge across the space, and contact a series of tools.

The tool box may include, without limitation, a toolbox, a medical device box, a tool chest, an auto cart, a cabinet, a weapons box, etc. The tools may include, without limitation, a hand tool, a socket, a socket wrench, a screw driver, a wrench, a power tool, screws, nails, nuts, bolts, pliers, small parts, medical devices, stethoscopes, weapons, ammunition, etc.

A further understanding of the nature and advantages of the present invention herein may be realized by reference to the remaining portions of the specification and the attached drawings. Further features and advantages of the present invention, as well as the structure and operation of various embodiments of the present invention, are described in detail below with respect to the accompanying drawings. In the drawings, the same reference numbers indicate identical or functionally similar elements.

DETAILED DESCRIPTION OF THE INVENTION

Reference will now be made in detail to the embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth to provide a thorough understanding of the present invention. However, it will be obvious to one of ordinary skill in the art that the present invention may be practiced without these specific details. In other instances, well-known methods, procedures, components, and circuits have not been described in detail as to not unnecessarily obscure aspects of the present invention.

Figure 1:
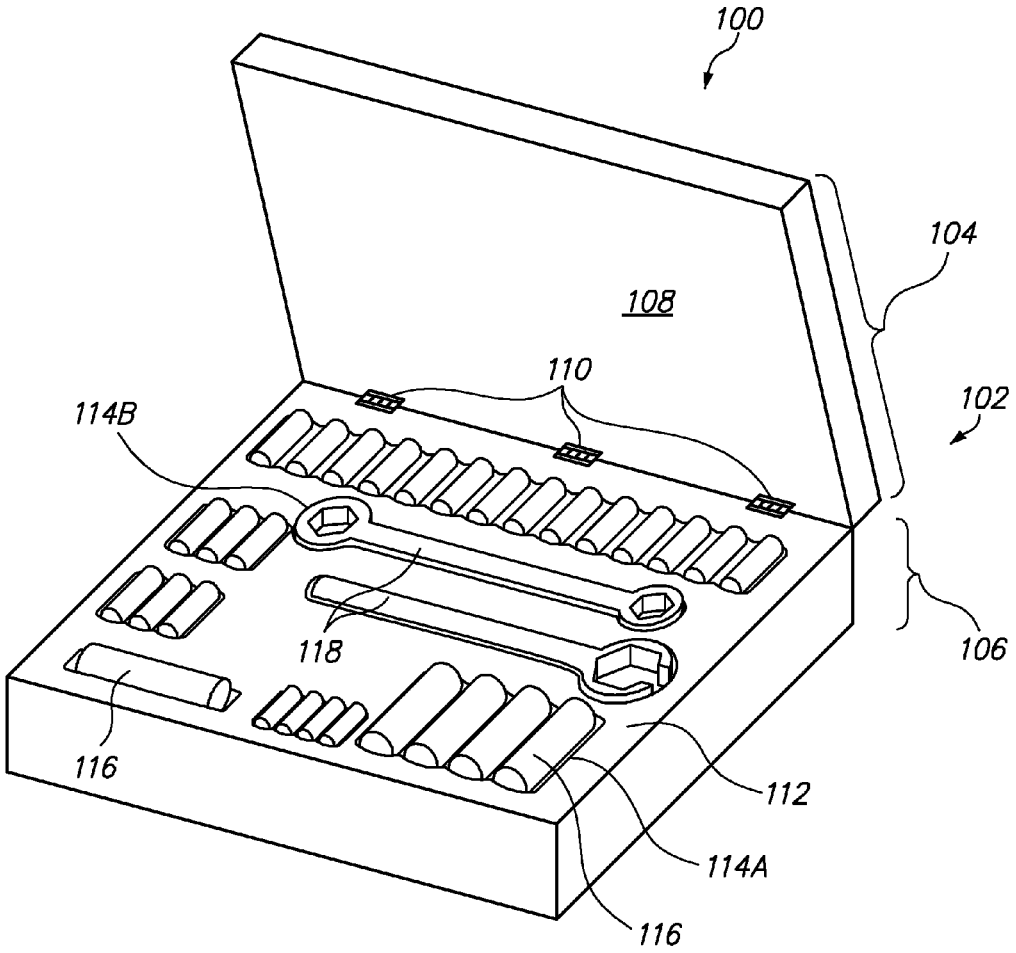
FIG. 1 illustrates a detailed perspective view of a tool box system in accordance with an exemplary embodiment of the present invention.

FIG. 1 illustrates a detailed perspective view of tool box system 100 in accordance with an exemplary embodiment of the present invention.

In FIG. 1, tool box system 100 comprises body 102, which is itself made up of upper body 104 and lower body 106. Body 102 serves as the casing for tool box system 100 and is preferably fabricated from high strength polymeric material to enclose and protect tools or other like appliances contained within body 102.

As implied by its name, lower body portion 106 is the lower portion of the tool box system; lower body portion 106 can receive one or more tools that are then securely retained and stored within body 102 based on principles and precepts of the present invention as further described with reference to figures below.

In FIG. 1, upper body portion 104 essentially comprises cover 108 mounted on lower body portion 106 via one or more hinges 110. In this manner, cover 108 can be opened to allow user-access to tools or closed to retain the tools therein.

Note, however, that cover 108 and lower body portion 106 can be attached via snap locks, sliding along grooves or clips and clamps, for example. In an alternate embodiment, tool box system 100 does not have cover 108 but rather depends on magnetic forces exerted by one or more magnets (FIGS. 2 & 3) in accordance with the present invention.

As shown, lower body portion 106 includes tool panel 112 and a corresponding magnet base panel 212 (FIG. 2) that house a plurality of magnets as further discussed with reference to FIG. 2. As can be seen, tool panel 112 includes a plurality of tool recesses 114A, 114B, each configured and contoured to receive a particular tool such as socket 116, and wrench 118 used in conjunction with socket 116. In some embodiments, the tool panel 112 provides a visible surface to display the at least one socket 116, wrench 118. In other embodiments, the tool panel 112 may completely enclose the tools (not shown).

Here, tool recess 114A might be contoured to receive socket 116, each of which might have different sizes. As another example, tool recess 114B might be contoured to receive wrench 118.

The tool recesses 114A, 114B are efficacious in providing a unique position for each socket 116, wrench 118 on the tool panel 112, and also enhancing the capability of each socket 116, wrench 118 to secure to its respective place on the tool panel 112. Those skilled in the art will recognize that the at least one recess 114A, 114B is comprised of a thinner material than the rest of the magnet base panel 212 (FIG. 2) for facilitating the distribution of the magnetic field.

However, in another embodiment, the aperture (not shown) in the at least one tool recess 116 positions between each magnet 222 (FIG. 2) and each socket 116, wrench 118 to remove any barrier for the magnetic field. In this embodiment, each socket 116, wrench 118 fastens directly to the magnet surface and is in direct contact with each magnet 222 through the aperture.

In other embodiments, each magnet 222 positions opposite each socket 116, wrench 118 inside the tool recess 114A or 114B, whereby the at least one magnet 222 generates a sufficiently strong and directed magnetic field for attracting the at least one socket 116, wrench 118. Those skilled in the art will recognize that the at least one tool recess 114A or 114B is comprised of a thinner material than the rest of the magnet base panel 212 for facilitating the distribution of the magnetic field.

In this embodiment, the at least one magnet 222 generates the magnetic field for attracting the at least one socket 116, wrench 118 towards the tool base panel 112. In this manner, the location of each socket 116, wrench 118 in the tool box 102 is predetermined. The at least one magnet 222 is sized and dimensioned to attract various types and sizes of the at least one socket 116, wrench 118.

Each magnet 222 is configured to attract a corresponding socket 116, wrench 118 including, without limitation, a multiplicity of rectangular shaped magnetic bars sized and oriented to approximate a respective tool recess 114A or 114B, a single magnet strip that positions along a longitudinal axis of the magnet base panel 212, and a multiplicity of magnet dots positioned behind each tool recess 114A or 114B.

Those skilled in the art, in light of the present teachings, will recognize that a smaller magnet 222 is beneficial for reducing the weight of the tool box 102, yet does not create a sufficient magnetic field to secure the at least one socket 116, wrench 118 onto the tool base panel 112. In some embodiments, the at least one magnet 222 provides a sufficiently strong magnetic field so that the force of gravity does not cause the at least one socket 116, wrench 118 to exit the tool box 102 or dislodge from the tool base panel 112 if the tool box 102 is longitudinally rotated 360 degrees and the cover 108 is removed.

Those skilled in the art, in light of the present teachings will recognize that matching the appropriate magnet 222 with the appropriately configured socket 116, wrench 118 is vital for an effective attraction between them. For example, without limitation, if the magnet 222 is too narrow, the generated magnetic field is not sufficiently strong attract a wide, round socket 116, wrench 118.

Similarly, if the magnet 222 is thick and large, a relatively light socket 116, wrench 118 is difficult to remove from the tool base panel 112 due to the excessively strong magnetic force between the light socket 116, wrench 118 and heavy magnet 222. In some embodiments, the orientation of multiple magnets 118 is configured to provide magnetic fields that reinforce and negate each other in different regions of the tool box 102.

In one alternative embodiment, each tool recess 114A or 114B is color coded to further facilitate the organization of each socket 116, wrench 118. In yet another alternative embodiment, an illumination portion provides illumination inside the tool box 102 for facilitated viewing of each socket 116, wrench 118. The illumination portion is powered by manipulating the magnetic field generated by the at least one magnet 222, whereby an electric current is generated.

In one embodiment, each magnet 222 is oriented and aligned in relation to each magnet 222 to enhance the magnetic field in a region of the tool box. Similarly, each magnet 222 may be oriented and aligned in relation to each magnet to diminish the magnetic field in a region of the tool box. Thus, the N and S poles of each magnet may be aligned so as either to enhance or diminish the magnetic field of a region.

The tool box system 100 is designed to organize, secure, and provide accessibility to the at least one socket 116, wrench 118 inside the tool box 102 by manipulating the position and dimensions of each magnet 222 in the tool box 102.

In operation, the cover 108 is removed to access the interior of the tool box. The magnet base panel 212 is oriented to position inside the lower body portion 106. At least one magnet 222 positions between the magnetic base panel 212 and the tool base panel 112. Each magnet 222 attaches to the magnet surface 110, orienting and matching with an appropriate socket 116, wrench 118 on the tool base panel 112. Each socket 116, wrench 118 positions in an appropriate tool recess 114A or 114B.

A magnet region (not shown) of the tool box provides a more temporary area to place each socket 116, wrench 118. At least one socket 116, wrench 118 is accessed for the desired function. After finishing with the socket 116, wrench 118, the socket 116, wrench 118 is returned either to the tool recess 114A or 114B or the magnet region. If the tool box 102 should spill over, the at least one socket 116, wrench 118 will remain in the tool box 102 due to the magnetic force between each socket 116, wrench 118 and each magnet 222.

Figure 2:
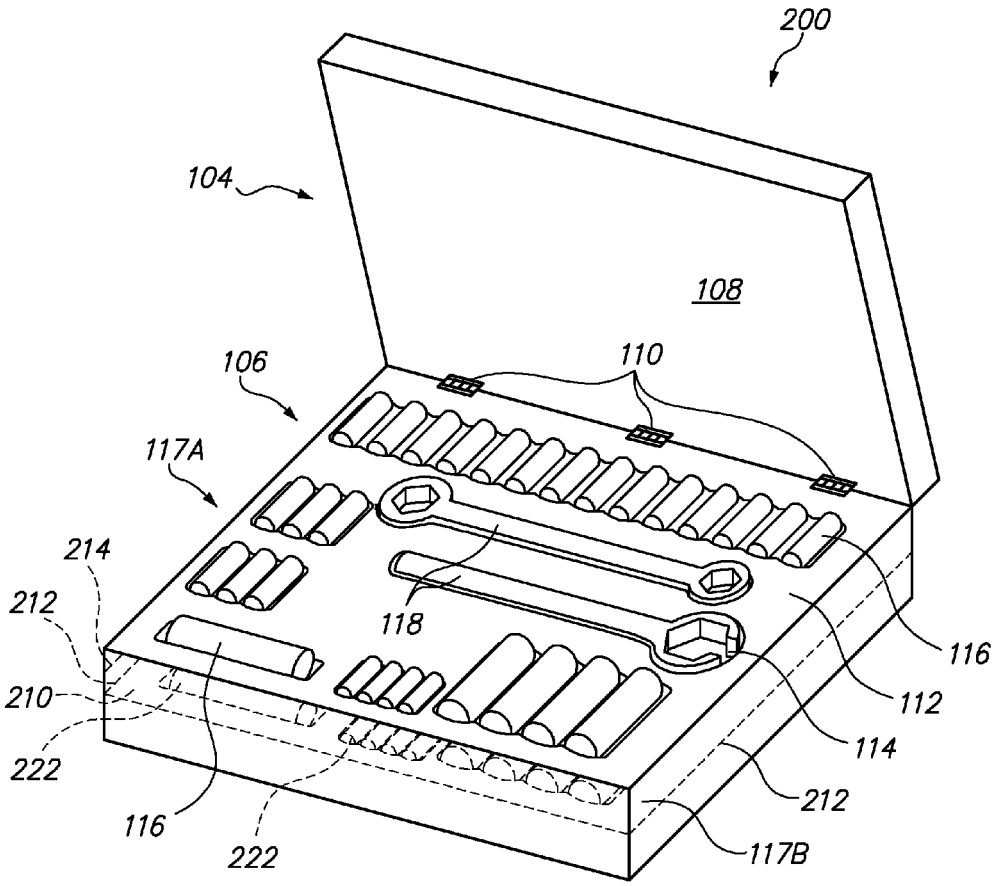
FIG. 2 illustrates a tool box system according to an exemplary embodiment of the present invention.

FIG. 2 illustrates tool box system 200 according to an exemplary embodiment of the present invention.

In FIG. 2, tool box system 200 also includes upper body portion 104 as well as lower body portion 106 similar to the tool box system 100 of FIG. 1. Here, lower body portion 106 includes magnet base panel 212 for housing a plurality of magnets 222.

The magnet base panel 212 comprises a magnet surface 210 for engaging the at least one magnet 222. Each magnet 222 is manipulated accordingly to provide optimal attraction with each tool. In some embodiments, the at least one magnet 222 fastens onto the magnet surface 210 through various means, including, without limitation, magnetic attraction, welding, screws and bolts, and adhesives. Each magnet 222 is sized, dimensioned and positioned to convey optimum magnetic capability to the appropriately located tools.

The manipulation of each magnet is useful for tailoring a desired magnetic attraction between the tools and the magnets. For example, lighter tools do not need to be attracted too strongly to the magnet or they will be difficult to remove from the tool box. Heavier tools, on the other hand, will dislodge from their respective location in the tool box if the magnetic attraction is too weak.

The magnet base panel 212 is conveniently located within lower body portion 106 so as to optimize magnetic capability between magnets 222 and socket 116 and wrench 118. In one embodiment, magnetic base panel 212 is adjustable within lower body portion 106 so that it can be raised up toward tool base panel 112 or lowered toward the lowermost point of lower body portion 106. Thus, a user may optimize magnetic capability by adjusting magnetic base panel 212 upwards to a higher location 214 as desired by the user. Alternatively, although not shown, tool base panel 112 might be adjustable to vary its height. The magnetic base panel 212 or the base tool panel may be removable.

Figure 3:
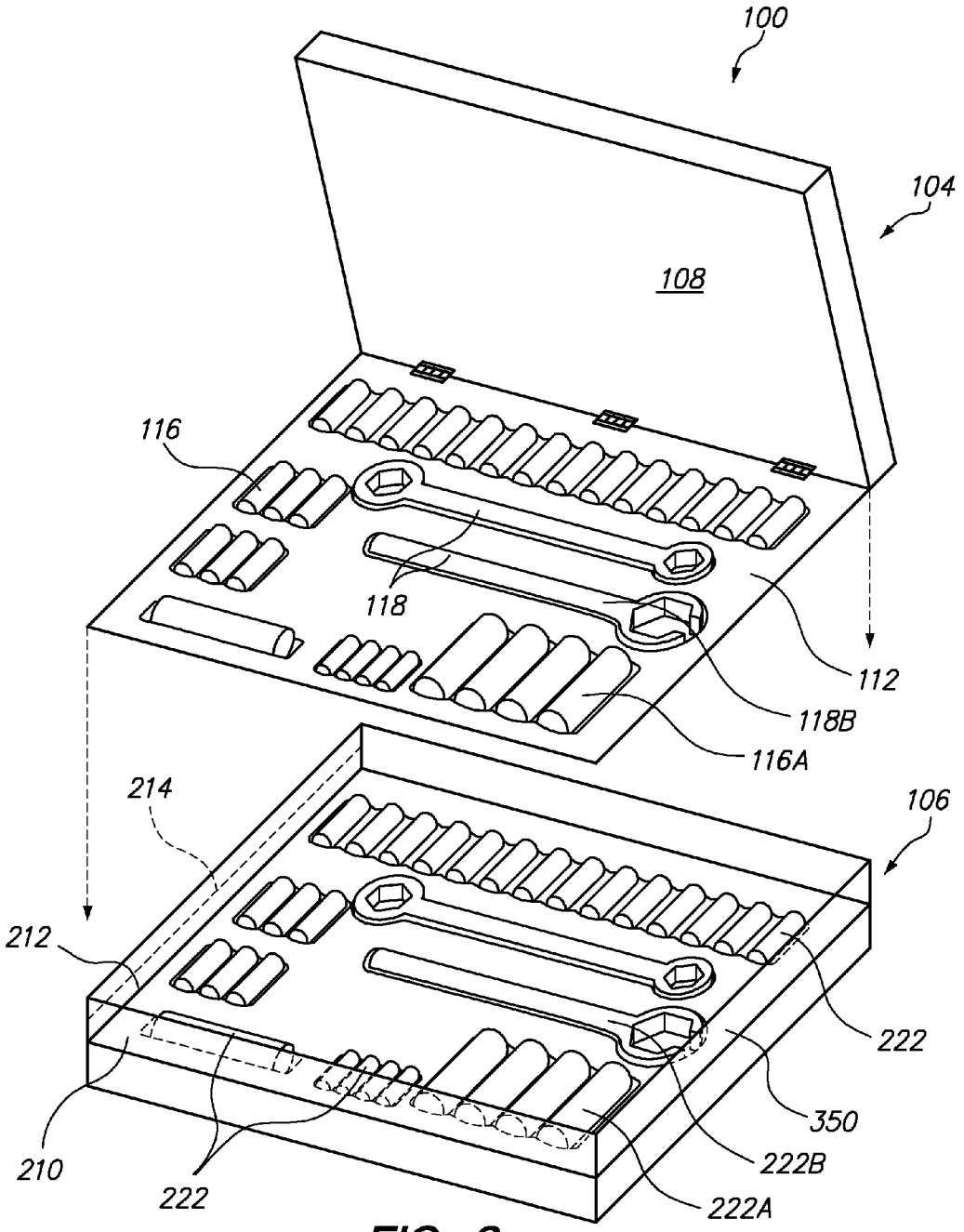
FIG. 3 illustrates a perspective view of the tool box system of FIGS. 1 and 2 according to an exemplary embodiment of the present invention.

FIG. 3 illustrates a perspective view of tool box system 100 according to an exemplary embodiment of the present invention.

In FIG. 3, tool box system 100 is depicted with its upper body portion 104 and lower body portion apart from each other. Here, upper body portion 104 including tool base panel 112 in which socket 118, wrench 116 are engaged. Here, base panel 112 is attached to cover 108 although one skilled in the art will realize that tool base panel 112 and cover 108 might be uncoupled from each other.

In FIG. 3, upper body portion 104 is configured and dimensioned to align and sit over lower body portion 106. Thus, when at rest, upper body portion 104 is engaged with lower body portion 106 as shown in FIGS. 1 and 2.

In one embodiment, upper body portion 104 can be separated from lower body portion 106 by simply disengaging both portions. In an alternate, embodiment the upper body portion 104 and lower body portion 106 are permanently affixed to each other.

In FIG. 3, lower body portion 106 includes its plurality of magnets 222 engaged on magnet base panel 212, which is positioned height wise so that magnets 222 are not protruding above sidewalls 350, such that upper body portion 106 can be rested above the lower body portion 106. As can be seen, in one embodiment, each magnet 222 is aligned with a corresponding socket 116, wrench 118.

For example, magnet 222(A) and socket 116(A) are aligned, thus, magnet 222(A) provides optimum magnetic field for retention of socket 116(A) until said socket is forcefully disengaged by the user. As another example, magnet 222(B) and wrench 118(B) are aligned, magnet 222(B) providing the requisite magnetic field for wrench 118(B).

While the above is a complete description of exemplary specific embodiments of the invention, additional embodiments are also possible. Thus, the above description should not be taken as limiting the scope of the invention, which is defined by the appended claims along with their full scope of equivalents.

I claim:

1. A tool box system comprising:

a tool box, the tool box being configured to contain at least one tool, the tool box comprising a cover, the cover being configured to restrict access to the at least one tool in the tool box, the tool box further comprising a body, the body comprising a body lower portion, the body lower portion being configured to receive the at least one tool, the body lower portion comprising at least one sidewall panel, the body lower portion further comprising a lower panel and a base;

wherein the lower panel has a tool surface on which the at least one tool is placed;

wherein the base is disposed below the lower panel and positioned parallel to the planar surface of the lower panel, the base comprising a magnet surface on which at least one magnet is placed, the at least one magnet being operable to generate a magnetic field for attracting the at least one tool, the at least one magnet being disposed on the magnet surface substantially directly below the at least one tool to position between the base and the lower panel, wherein each magnet orients and aligns along the magnet surface with respect to each tool on the tool surface to optimize the attraction between them, wherein each magnet is of a similar dimension and of a similar size as each tool to optimize the attraction between them; and wherein a height of the base in the lower body portion is adjustable from a first position to a second position to increase or reduce magnetic field attraction between the at least one magnet and the at least one tool.

2. The tool box system of claim 1, wherein the at least one magnet is sized and dimensioned to attract a multiplicity of tools.

3. The tool box system of claim 2, wherein each magnet is oriented and aligned in relation to each magnet to enhance the magnetic field in a region of the tool box.

4. The tool box system of claim 3, wherein each magnet is oriented and aligned in relation to each magnet to diminish the magnetic field in a region of the tool box.

5. The tool box system of claim 4, wherein the at least one magnet is dimensioned to minimize the weight of the tool box.

6. The tool box system of claim 5, wherein the base is disposed to position between the at least one magnet and the at least one tool.

7. The tool box system of claim 6, wherein the at least one magnet is configured to engage the magnet surface.

8. The tool box system of claim 7, wherein the at least one tool is configured to engage the tool surface.

9. The tool box system of claim 8, wherein the base comprises at least one tool recess, the at least one tool recess being configured to contour the shape of the at least one tool.

10. The tool box system of claim 9, wherein the at least one tool recess comprises at least one aperture, the at least one aperture being configured to enable the at least one magnet and the at least one tool to at least partially engage.

11. The tool box system of claim 10, wherein the base is removable.

12. The tool box system of claim 11, wherein each magnet is in direct contact with each tool.

13. A tool box system comprising:

a tool box, the tool box being configured to contain at least one tool, the tool box comprising a cover, the cover being configured to restrict access to the at least one tool in the tool box, the tool box further comprising a body, the body comprising a body lower portion, the body lower portion being configured to receive the at least one tool, the body lower portion comprising at least one sidewall panel, the body lower portion further comprising a lower panel and a base;

wherein the lower panel has a tool surface on which the at least one tool is placed;

wherein the base is disposed below the lower panel and positioned parallel to the planar surface of the lower panel, the base comprising a magnet surface on which at least one magnet is placed, the at least one magnet being operable to generate a magnetic field for attracting the at least one tool, the at least one magnet being disposed on the magnet surface substantially directly below the at least one tool to position between the base and the lower panel, wherein each magnet orients and aligns along the magnet surface with respect to each tool on the tool surface to optimize the attraction between them, wherein each magnet is of a similar dimension and of a similar size as each tool to optimize the attraction between them and wherein a height of the lower panel in the lower body portion is adjustable from a first position to a second position.

* * * * *